US006138448A

United States Patent [19]

Kataoka

[11] Patent Number: 6,138,448

[45] Date of Patent: Oct. 31, 2000

[54] YARN HEATING APPARATUS

[75] Inventor: Shigenori Kataoka, Osaka, Japan

[73] Assignee: Murata Kikai Kabushiki Kaisha, Kyoto, Japan

[21] Appl. No.: 09/143,103

[22] Filed: Aug. 28, 1998

[30] Foreign Application Priority Data

Sep. 29, 1997 [JP] Japan ..... 9-263632

[51] Int. Cl.[7] ..... D01H 7/46

[52] U.S. Cl. ..... 57/290; 57/284; 57/282; 57/287; 28/240

[58] Field of Search ..... 57/290, 284, 282, 57/287; 28/240, 249, 250; 219/388

[56] References Cited

U.S. PATENT DOCUMENTS

| | | | |
|---|---|---|---|
| 3,015,872 | 1/1962 | Jones | 28/62 |
| 4,236,323 | 12/1980 | Dammann et al. | 34/152 |
| 4,641,504 | 2/1987 | Runkel et al. | 68/5 E |
| 5,193,334 | 3/1993 | Dammann | 57/284 |
| 5,519,924 | 5/1996 | Fujita | 28/240 |
| 5,718,109 | 2/1998 | Fujita | 57/290 |

FOREIGN PATENT DOCUMENTS

| | | | |
|---|---|---|---|
| 3301510 | 8/1983 | Germany | 57/290 |
| 7-9984 | 2/1995 | Japan . | |
| 332227 | 9/1989 | United Kingdom | 57/290 |

*Primary Examiner*—John J. Calvert
*Assistant Examiner*—Mary K. Fiore
*Attorney, Agent, or Firm*—Armstrong, Westerman, Hattori, McLeland and Naughton

[57] ABSTRACT

To provide a yarn heating apparatus offering greater heating efficiency and ease of manufacture than a conventional yarn heating apparatus. Provide two heating spaces for yarn, and make the middle heating part 13*a* between these two heating spaces 10*a*, 10*b* detachable. By doing this, yarn can be heated sufficiently and the heating unit can be manufactured more easily. Place heating units 17, 17 on both side of the heating space 10*a*, 10*b* through which the two yarns will pass. By doing this, heat is radiated from both sides of the heating space 10*a*, 10*b* towards the yarn, heating the entire heating space uniformly. Taper the heating space 10*a*, 10*b* towards the yarn inserting port and make the wall facing the heating space 13*a*, 13*b* flat. This makes it easier to manufacture the wall.

8 Claims, 6 Drawing Sheets

YARN HEATING APPARATUS

FIELD OF THE INVENTION

The present invention relates to the yarn heating apparatus used for the draw texturing machine. More specifically, the present invention concerns the yarn heating apparatus used for doubling yarns.

BACKGROUND OF THE INVENTION

With the conventional draw texturing machine, when a plurality of yarns are doubled, each yarn passes through separate heating spaces. To meet needs for more compact machines, a yarn heating apparatus that allows more than a yarn to pass through the same heating space was recently developed.

The construction of this newly developed yarn heating apparatus 3, however, is such that a first heat insulator 8 is packed in an outer case 7, an inner case 9 is provided inside the outer case 7, and a second heat insulator 11 provided with a heating space 10 is packed inside the inner case 9, as shown in the sectional view in FIG. 6. The bottom sides of the heating space 10 and the second heat insulator 11 are open and face the outside. A heating unit 13 comprising two buried sheath heaters 12 is provided in the heating space 10, and a middle heat insulator 14, which laterally divides the heating space 10 into two heating spaces 10*a* and 10*b*, is provided below the heating unit 13. A plurality of yarn guides 15 are placed with appropriate spacing in the two heating spaces 10*a* and 10*b*. The yarn guides 15 are mounted to the second heat insulator 11 on both sides of the heating space.

The above-described yarn heating apparatus 3, however, has a drawback, because the heating unit 13 is at some distance from the yarn which is guided by the inner groove 15*a* or the outer groove 15*b* of the yarn guide 15, the yarn cannot be heated sufficiently.

SUMMARY OF THE INVENTION

The present invention eliminates this drawback, and is intended to provide a yarn heating apparatus offering increased heating efficiency and ease of manufacture.

To slove the above-described problem, the present invention adopts a yarn heating apparatus characterized by the use of two heating spaces through which yarn passes, and by the provision of a heating part between the two heating spaces that is detachable from a heating unit. Relative to conventional yarn heating apparatuses, this new apparatus is able to better heat yarn. Furthermore, compared to the apparatus employing integrated heating unit, it enables the heating unit to be manufactured easily, and prevents the heating unit from being deformed.

The present invention employs additional means including a yarn heating apparatus characterized by the provision of heating units on both sides of the yarn heating space through which two yarns pass. With the yarn heating apparatus, the two yarns can be heated sufficiently and equally.

Another means adopted by the present invention is a yarn heating apparatus in which the yarn heating space is tapered towards the yarn inserting port, and the wall facing the heating space is formed flat. Since this wall is linearly flat, it is easy to manufacture.

DETAILED DESCRIPTION OF THE PREFERRED EMBODIMENTS

Figure 1:
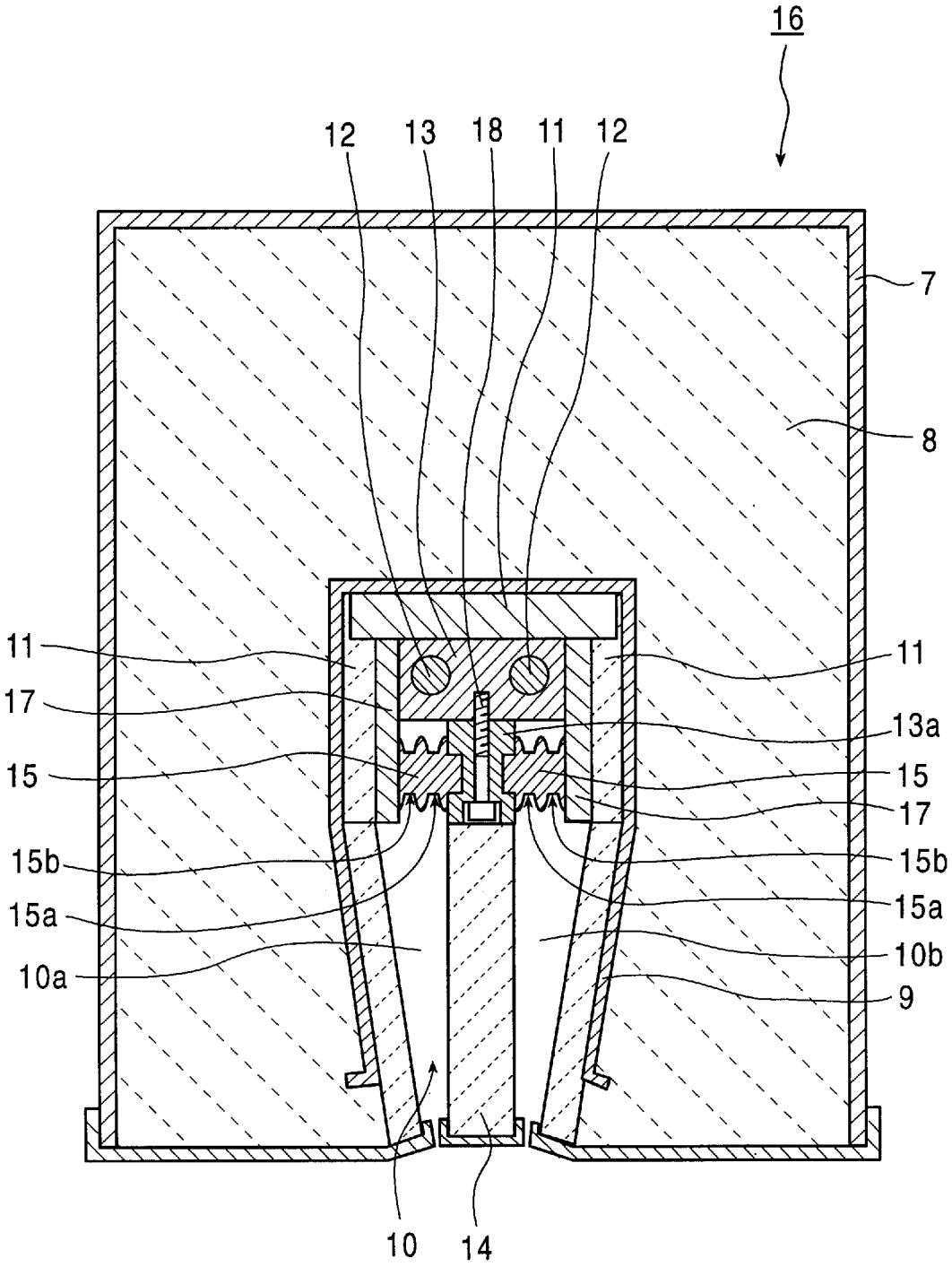
FIG. 1 is a vertical sectional view showing the yarn heating apparatus associated with the first embodiment of the present invention.

The structure of the present invention is explained below in terms of embodiments with reference made to certain drawings. It should be noted that parts used in the conventional yarn heating apparatus are indicated using the same reference numerals for the present invention. FIG. 1 is a vertical sectional view of the yarn heating apparatus 16 associated with its first embodiment.

As shown in FIG. 1, this yarn heating apparatus 16 has two heating spaces 10*a* and 10*b*, and is configured so that two yarns can pass through each heating space 10*a*, 10*b*. The heating unit 17,17 which is made from brass and so on, and the same material used for the heating unit 13, is mounted onto the inner side of each heat insulator 11 which is respectively placed on the outer side of each heating space 10*a*, 10*b*. Inside each heating space 10*a*, 10*b*, a plurality of yarn guides 15 are placed at specified spacing in the direction the yarn will pass.

The middle heating part 13*a* of the heating unit 13, which partitions the heating spaces 10*a*, 10*b*, can be split so that it can be removed from and attached to the heating unit 13 by using a bolt 18. To this middle heating part 13*a*, the yarn guide 15 is screwed in place to allow detachability. The positional relationship between the sheath heaters 12, 12 and each yarn is established so that each yarn that is guided by the inner yarn guide groove 15*a* or outer yarn guide groove 15*b* of each yarn guide 15, 15 positioned within two heating spaces 10*a*, 10*b*, is equally distanced from each sheath heater (heating source) 12, 12. The distance from the inner yarn guide groove 15*a* to the middle heating part 13*a* and the distance from the outer yarn guide groove 15*b* to the heating unit 17 are set to be roughly equal.

The inside surfaces of the heat insulator 11 and 14 that form each heating space 10*a*, 10*b* are formed linearly. Since the middle heating part 13*a* is detachable with the bolt 18, the heating part 13*a* is relatively easy to install and since the yarn guide 15 is mounted onto the middle heating part 13*a*, the yarn guide 15 is easier to maintain. Moreover, since the yarn guide 15 is mounted onto the middle heating part 13*a*, it can be heated more efficiently. Furthermore, since the inside surface of each heat insulator 11 and 14 is linear, it is easy to manufacture. With such a yarn heating apparatus provided with the heating units 17, 17 in two heating spaces 10*a*, 10*b*, heat can be applied from three sides, that is, the sheath heater 12 side, the heating unit 17 side and heating part 13*a* side, excluding the bottom side, to the yarns, thereby improving heating efficiency and allowing high-temperature heat to be applied. In addition, the atmospheric temperature inside the heating spaces 10*a*, 10*b* is equal.

Figure 2:
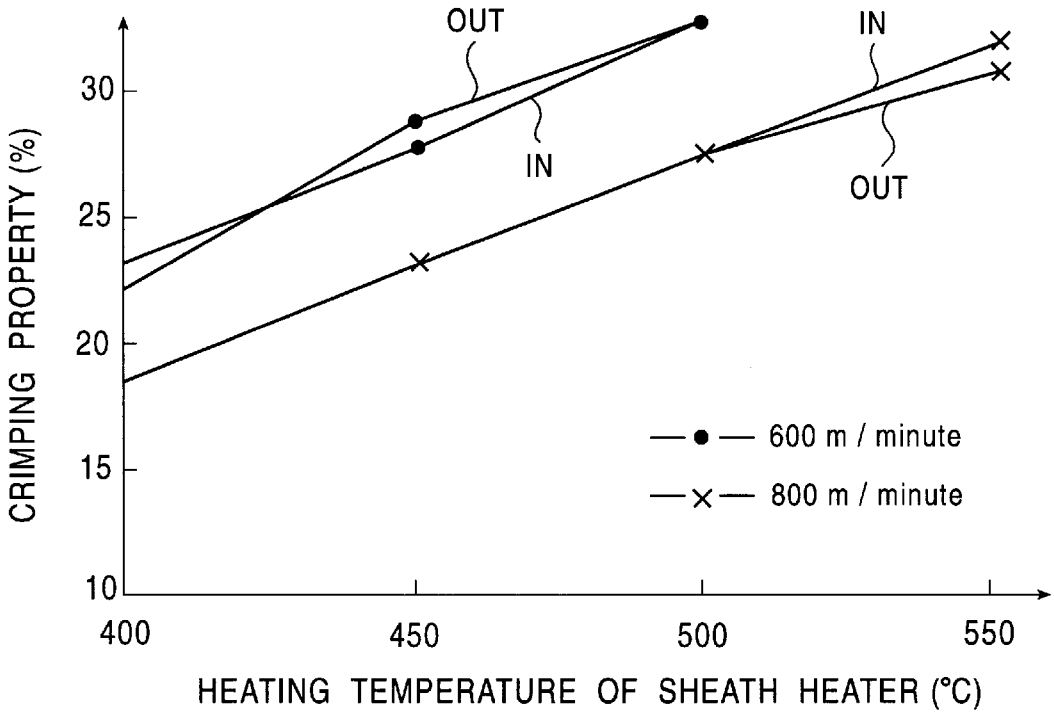
FIG. 2 is a graph showing the relationship between the yarn's crimping property and the heating temperature of the sheath heater in the yarn heating apparatus associated with the first embodiment of the present invention.

The yarn heating apparatus associated with this embodiment creates a relationship between the crimping property of yarn and the heating temperature of the sheath heater 12, as shown in FIG. 2. That is, there is little difference in crimping properties between the yarn at the inner groove 15*a* and the yarn at the outer groove 15*b* of the yarn guide 15. Such a finding indicates that the atmospheric temperature in the heating space 10*a* is nearly the same as that in the heating space 10*b*. It is clear in comparison with FIG. 5, which shows the same property for a yam heating apparatus from which heating units 17, 17 on both sides have been removed (the middle heating part 13*a* is installed).

Figure 3A:
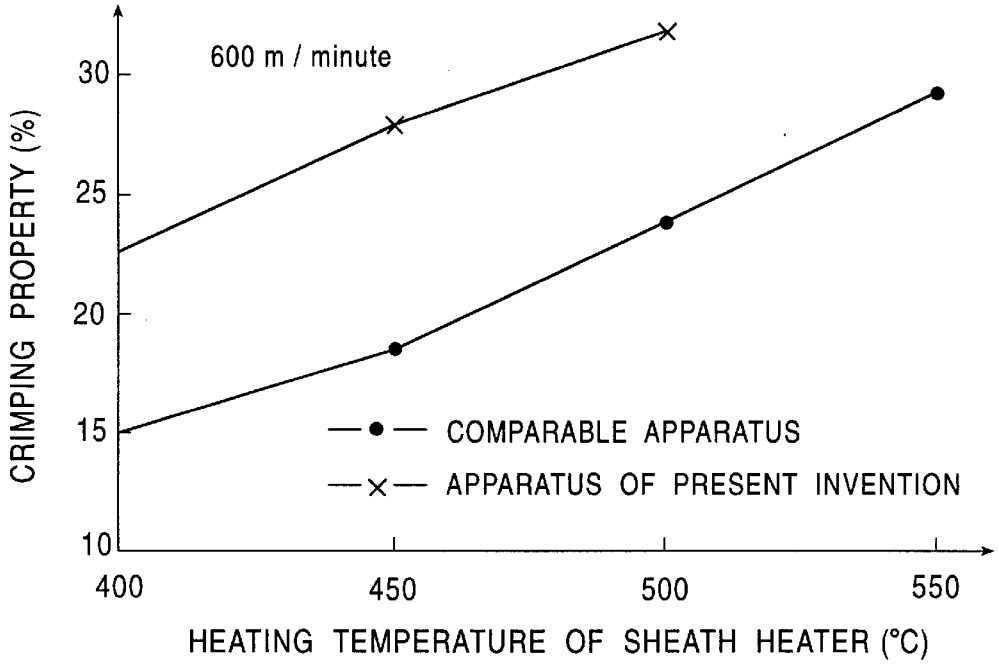
FIG. 3 is a graph comparing heating performance for the yarn heating apparatus associated with the present invention and for a comparable yarn heating apparatus.
Figure 3B:
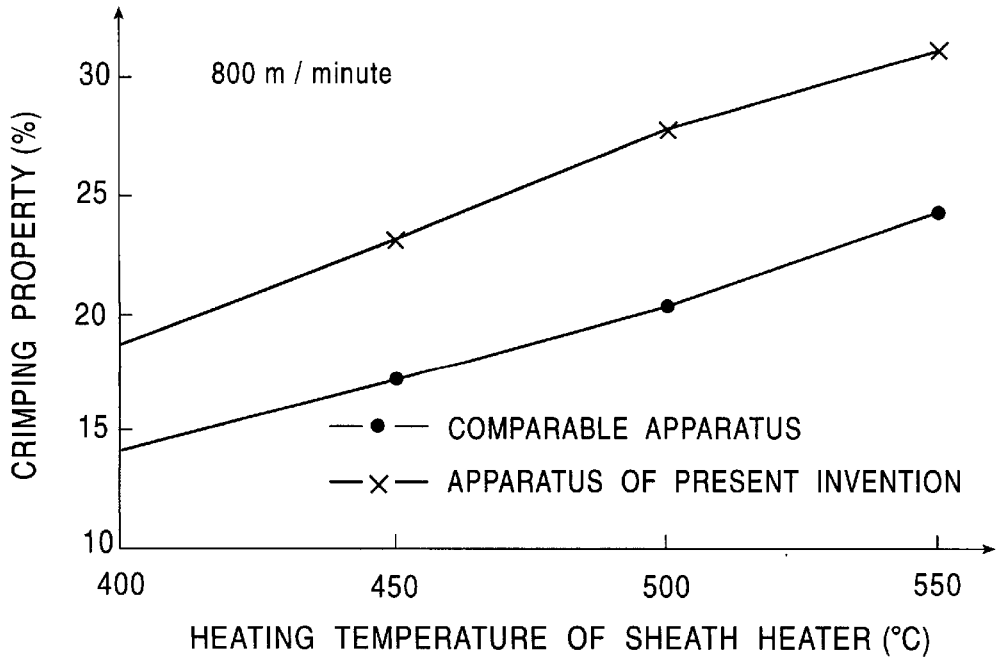

FIG. 3 compares the relationship between the crimping property of yarn and the heating temperature of heater 12 for the present invention with those of a comparable yarn heating apparatus, and FIG. 3A shows results for a yarn transfer rate of 600 m/minute, while FIG. 3B shows results for a rate of 800 m/minute. "Crimping property" in the figures show the mean value of yarn at the inner and outer grooves is 15*a*, 15*b* of the yarn guide 15. As is clear from FIG. 3, the yarn heating apparatus 16 associated with this embodiment yields yarn with more desirable crimping properties, and is able to better heat the yarn in the heating space 10*a*, 10*b* than the comparable yarn heating apparatus.

Figure 4:
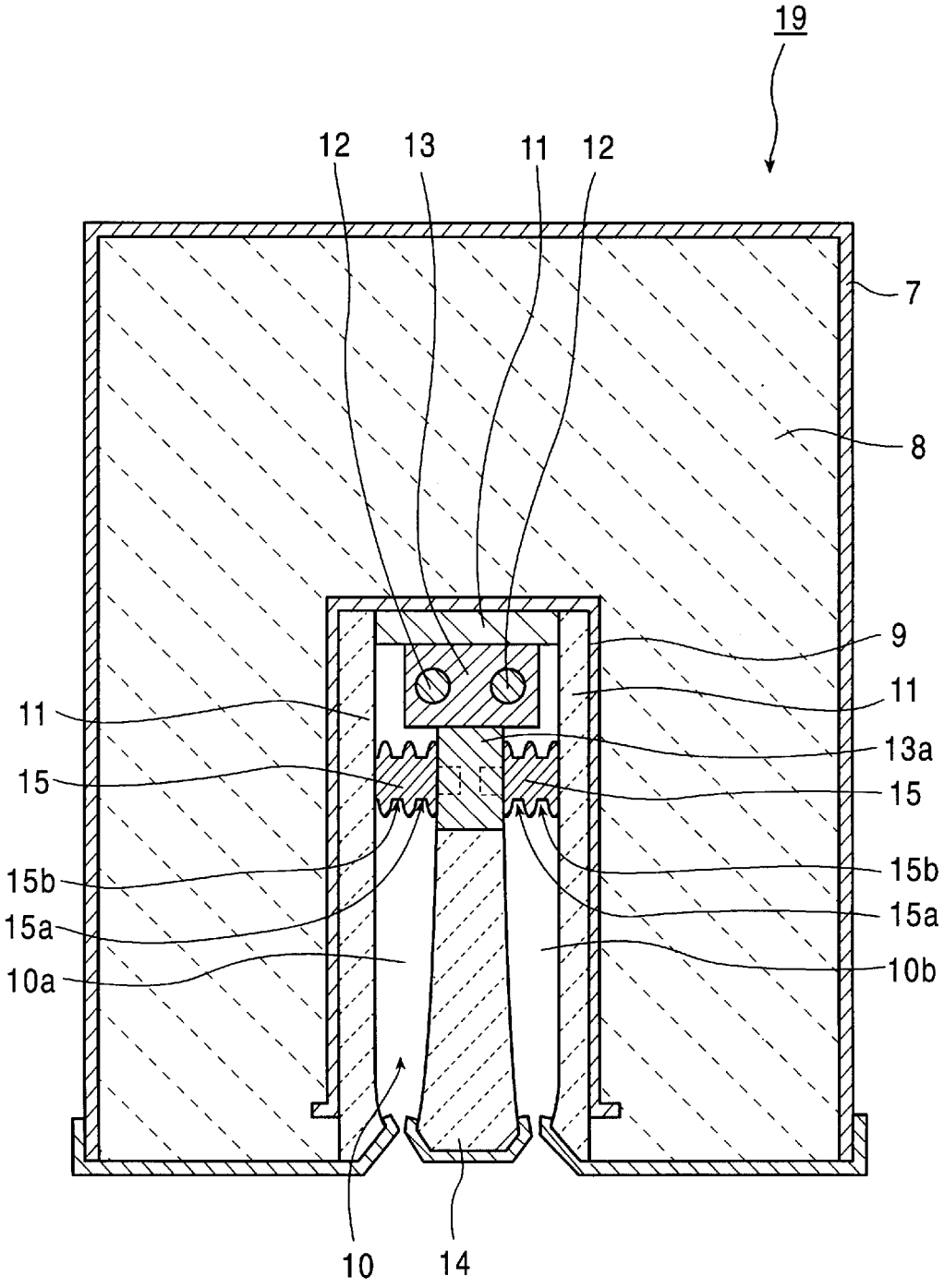
FIG. 4 is a vertical sectional view showing the yarn heating apparatus associated with the second embodiment of the present invention.

FIG. 4 is a sectional view of the yarn heating apparatus 19 associated with the second embodiment of the present invention. With this yarn heating apparatus 19, a first heat insulator 8 is pated in the outer case 7, the inner case 9 is provided inside the outer case 7, and a second heat insulator 11 is packed inside the inner case 9 so as to form a heating space 10. The bottom sides of the heating space 10 and the second heat insulator 11 are open and face the outside. The heating unit 13 into which two sheath heaters 12 are buried is placed inside the heating space 10, and the middle heating part 13*a* that divides the heating space 10 into two side-to-side heating spaces 10*a*, 10*b* is mounted at the bottom side of the heating unit 13. Moreover, a heat insulator 14 is provided at the bottom side of the middle heating part 13*a*. A plurality of yarn guides 15 are arranged at regular spacing inside the two heating spaces 10*a*, 10*b*, and these yarn guides 15 are screwed into the middle heating part 13*a* so that each yarn guide 15 can be removed and replaced.

Figure 6:
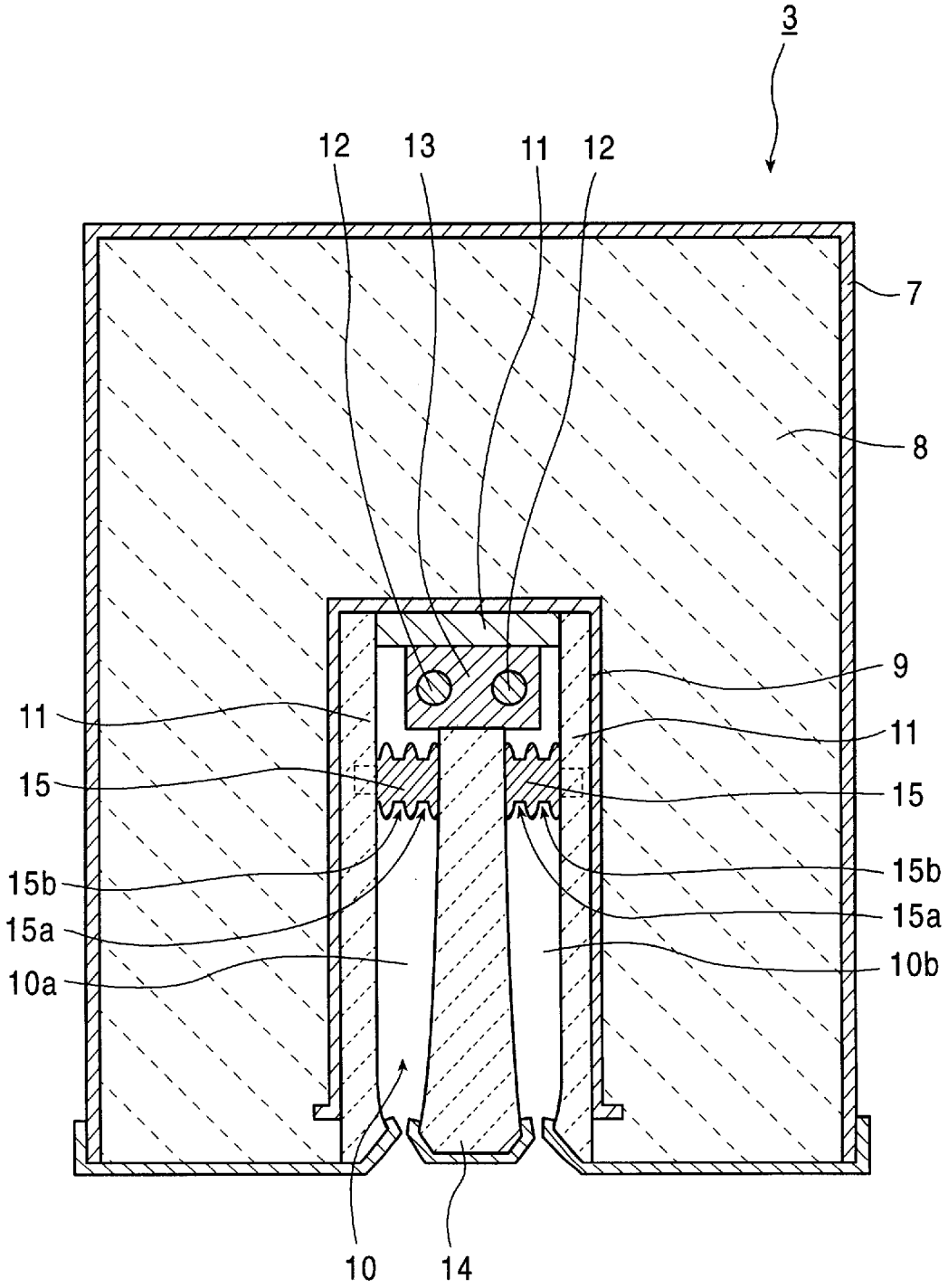
FIG. 6 PRIOR ART
FIG. 6 is a vertical sectional view showing a conventional yarn heating apparatus.

With this yarn heating apparatus 19, heat from two sheath heaters 12 is transmitted through the heating unit 13 and the middle heating part 13*a*, and yarn guided by each yarn guide 15 is heated both by heat radiated across the heating space 10*a*, 10*b* and by heat directly transmitted from the middle heating part 13*a*. For this reason, heating efficiency is better than with the conventional yarn heating apparatus 3 shown in FIG. 6.

Figure 5:
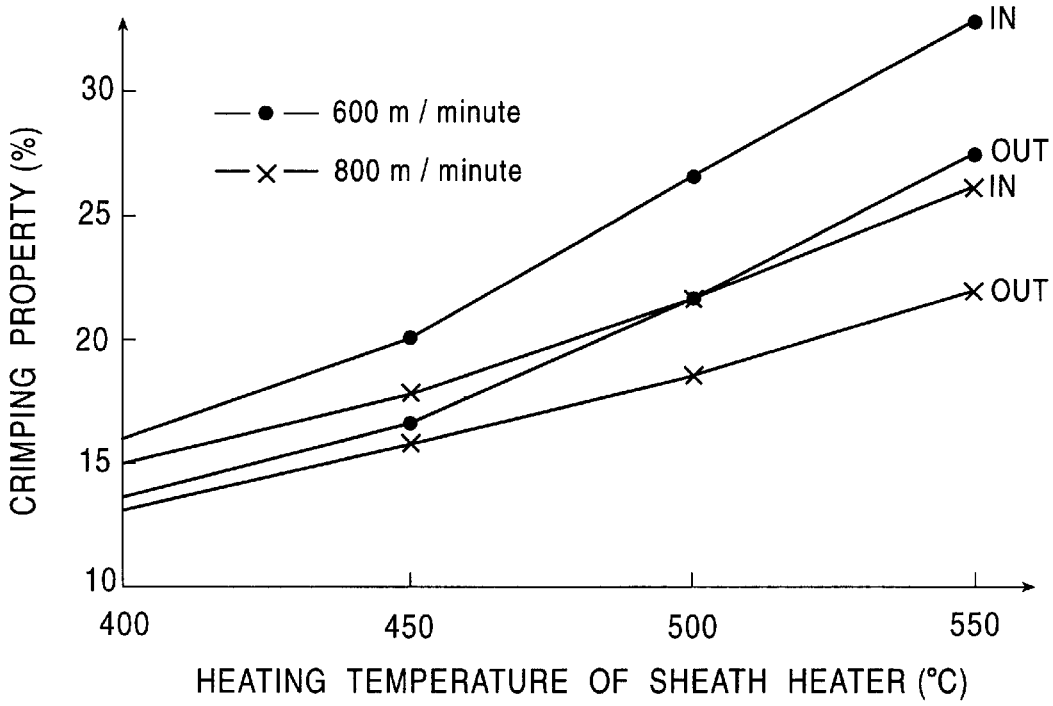
FIG. 5 is a graph showing the relationship between the yarn's crimping property and the heating temperature of the sheath heater in the yarn heating apparatus associated with the second embodiment of the present invention.

FIG. 5 is a characteristic diagram showing the relationship between the yarn's crimping property and the heating temperature of the heater 12 in the yarn heating apparatus 19 associated with the second embodiment. In FIG. 5, "IN" indicates that yarn is guided by the inner groove 15*a* of the yarn guide 15 and "OUT" indicates that yarn is guided by the outer groove 15*b* of the yarn guide 15. Measurements were taken at two yarn transfer rates, 600 m/minute and 800 m/minute.

The present invention is not limited to the embodiments mentioned above, it can also be modified slightly. For instance, a yarn doubling machine can use yarns which are not false-twisted, and apply false twist while they are being heated by this yarn heating apparatus and then double the yarns.

As explained above, because the present invention provides two yarn heating spaces as well as a detachable heating part between these heating spaces, it is able to heat yarn more sufficiently than conventional apparatus. Moreover, its heating unit is easier to manufacture and is prevented from being deformed.

With the present invention, since the heating units are placed on both sides of the yarn heating space, two yarns can be heated sufficiently and evenly.

With the present invention, since the yarn heating space is tapered towards the yarn inserting port, and the wall facing the heating space is formed flat, the wall is linearly flat and easy to manufacture.

I claim:

1. A yarn heating apparatus, comprising:

a housing including a heating zone therein and a middle heat insulator disposed within said heating zone to form a pair of spaced heating spaces, each of said heating spaces having an outer side and an inner side;

a yarn guides groove thereon inner yarn guide groove and an outer yarn guide groove thereon each of disposed between said outer side and inner side of said heating spaces, each of said yarn guides having an inner yarn guide groove and an outer yarn guide groove thereon; and a heating member provided at least on one side of each of said heating space through which two yarns pass.

2. A yarn heating apparatus according to claim 1, wherein heating members are respectively provided on both sides of the heating spaces.

3. A yarn heating apparatus according to claim 1, wherein a heating source is positioned in such a manner that two yarns guided by one of the yarn guides are maintained at equal distance from the heating source.

4. A yarn heating apparatus according to any one of claims 1, 2 or 3, wherein each heating space through which two yarns pass is tapered towards a yarn inserting port and that a wall facing the heating space is made flat.

5. A yarn heating apparatus according to any one of claims 1, 2 or 4, wherein a middle heating part provided on said middle heat insulator between the two heating spaces is detachable.

6. A yarn heating apparatus according to claims 5, wherein yarn guides are provided on the heating part arranged between the two heating spaces.

7. A yarn heating apparatus according to claim 2, wherein a distance between the heating member on the outer side of the heating space and the outer yarn guide groove is equal to a distance between the heating member on the inner side of the heating space and the inner yarn guide groove.

8. A yarn heating apparatus according to claim 5, wherein a middle heating part provided on said middle heat insulator between the two heating spaces is detachable.

* * * * *